United States Patent [19]

Shiina

[11] Patent Number: 4,711,823

[45] Date of Patent: Dec. 8, 1987

[54] HIGH STRENGTH STRUCTURAL MEMBER MADE OF AL-ALLOY

[75] Inventor: Haruo Shiina, Shiki, Japan

[73] Assignee: Honda Giken Kogyo Kabushiki Kaisha, Tokyo, Japan

[21] Appl. No.: 795,586

[22] Filed: Nov. 6, 1985

[30] Foreign Application Priority Data

Nov. 12, 1984 [JP] Japan ..... 59-236734

[51] Int. Cl.[4] ..... C21D 1/06; C22C 21/04; B22F 3/14

[52] U.S. Cl. ..... 428/547; 419/29; 419/48; 75/249

[58] Field of Search ..... 428/547, 548; 75/249; 420/548, 532, 534, 537, 538, 541, 546, 547, 549

[56] References Cited

U.S. PATENT DOCUMENTS

| | | | |
|---|---|---|---|
| 3,380,820 | 4/1968 | Hetke et al. | 420/550 |
| 3,727,524 | 4/1973 | Nishiyama et al. | 92/169 |
| 4,069,369 | 1/1978 | Fedor et al. | 428/557 |
| 4,177,069 | 12/1979 | Kobayashi et al. | 75/213 |
| 4,297,976 | 11/1981 | Bruni et al. | 123/193 CP |
| 4,460,541 | 7/1984 | Singleton et al. | 419/84 |

FOREIGN PATENT DOCUMENTS

| | | | |
|---|---|---|---|
| 1153209 | 9/1983 | Canada | 420/550 |
| 57-101641 | 6/1982 | Japan | 148/438 |
| 2090290 | 7/1982 | United Kingdom | 148/437 |

*Primary Examiner*—John F. Terapane
*Assistant Examiner*—Eric Jorgensen
*Attorney, Agent, or Firm*—Armstrong, Nikaido, Marmelstein & Kubovcik

[57] ABSTRACT

A high strength structural member made of Al-alloy is essentially formed of a sintered body of Al-alloy powder containing Si and Fe in the proportion of $10 \leqq Si \leqq 30$ wt. % and $4 \leqq Fe \leqq 33$ wt. %, and the surface layer of the sintered body is subjected to remelting-solidifying treatment with a high-density energy source such as a laser beam, a plasma arc, a TIG arc, etc. In the treated surface layer of the sintered body, grain sizes of Si crystal grains and precipitated intermetallic compound are reduced to 1 μm or smaller, whereas in the base portion of the sintered body that is not subjected to the remelting-solidifying treatment, grain sizes of Si crystal grains and precipitated intermetallic compound are kept 10 μm or smaller.

4 Claims, No Drawings

HIGH STRENGTH STRUCTURAL MEMBER MADE OF AL-ALLOY

BACKGROUND OF THE INVENTION

1. Field of the Invention

The present invention relates to a high strength structural member made of Al-alloy which has been produced through a powder metallurgical process.

2. Description of the Prior Art

In an internal combustion engine for motor vehicles, in order to realize reduction of weight of a vehicle body aluminium-alloy materials have been positively employed, and especially it is effective also for reducing an inertial force to form moving parts such as connecting rods, pistons and the like of aluminium-alloy materials. Such moving parts are required to have heat-resistivity and high strength because they are used under a severe condition at a high temperature, and in order to fulfil this requirement, there is a tendency of employing powder metallurgical products in which alloy elements can be added with a large freedom.

Al-alloy for powder metallurgical products in which high proportions of Si, Fe and other elements were added to Al aiming at improvements in a high-temperature strength, a Young's modulus, an abrasion-proofness and a heat-resistivity, was previously proposed in Japanese Patent Application No. 59-166979 which was filed by the Assignee of this application.

However, as a result of various investigations on such high strength aluminium-alloys, it was concluded that in order to apply the aluminium-alloy to a structural member for which a high fatigue strength is required such as a crank shaft, it is desirable to contemplate further increase of strength.

For the purpose of satisfying this requirement, it may be conceived to produce a thick surface film on the surface of the member by hardening anodic oxidation treatment that is known as a surface hardening process for aluminium alloy, but this treatment is hard to be employed for the reasons that it does not contribute to improvement in strength of a member although it is effective for improving an abrasion resistivity. The expense for the treatment is high.

SUMMARY OF THE INVENTION

It is therefore one object of the present invention to provide a high strength structural member made of Al-alloy which has its fatigue strength enhanced by surface hardening treatment while maintaining a heat-resistivity and a high-temperature strength of its base portion (internal portion).

The inventor of this invention paid attention to an effective process as a surface hardening process for iron series materials, that is, to the process in which after remelting by the action of a laser beam, a plasma arc, a TIG arc (inert-gas tungsten-arc) or the like having high-density energy, a surface layer is cooled in itself to be hardened and thereby enhancement of an abrasion-proofness and a strength is achieved, and this process was applied to the aluminium-alloy.

According to one feature of the present invention, there is provided a high strength structural member made of Al-alloy, in which a surface layer of a sintered body formed of Al-alloy powder containing Si and Fe in the proportions of $10 \leqq Si \leqq 30$ wt. % and $4 \leqq Fe \leqq 33$ wt. % has been subjected to remelting-solidifying treatment with a high-density energy source, whereby grain sizes of Si crystal grains and precipitated intermetallic compound in the remelted-solidified layer are made 1 μm or smaller and grain sizes of Si crystal grains and precipitated intermetallic compound in the base body portion that is not subjected to the remelting-solidifying treatment are 10 μm or smaller.

In an Al—Si series alloy containing a large amount of Si, since only a little Si can be dissolved in an α-solid-solution, brittle Si crystals are precipitated as dispersed in the α-solid-solution, and in the case of a cast product, the grain size of the Si crystal grains is as large as about 40 to 60 μm. If this cast product is locally remelted and thereafter solidified, the treated portion is quenched and hardened with micro-fine Si crystals of about 1 to 4 μm in grain size precipitated therein, but the grain sizes of Si crystal grains in an untreated portion is not varied, and hence, the treatment does not result in improvements in a fatigue strength of the cast product as a whole.

Whereas, according to the present invention, by forming the sintered body of Al-alloy powder containing Si and Fe in the proportions of $10 \leqq Si \leqq 30$ wt. % and $4 \leqq Fe \leqq 33$ wt. % the grain sizes of the Si crystal grains and precipitated intermetallic compound are made 10 μm or smaller. By subjecting the surface layer of the sintered body to remelting-solidifying treatment the above-described respective precipitates are finely dispersed into grain sizes of 1 μm or smaller, and thereby, great increase of a fatigue strength has been achieved.

DETAILED DESCRIPTION OF THE INVENTION

The sintered body according to the present invention is obtained preferably through the steps of press-shaping Al-alloy powder, heating the powder press-shaped article to perform hot extrusion working, and hot forging the extrusion shaped article.

Also, the Al-alloy to be used as powder material essentially contains Si and Fe in the proportions of $10 \leqq Si \leqq 30$ wt. % and $4 \leqq Fe \leqq 33$ wt. %. In addition to the aforementioned elements, if at least one element selected from a group consisting of Mn, Zn, Li and Co, Cu and Mg are added in the proportion ranges of $1.5 \leqq Mn \leqq 5.0$ wt. %, $0.5 \leqq Zn \leqq 10$ wt. %, $1.0 \leqq Li \leqq 5.0$ wt. %, $0.5 \leqq Co \leqq 3.0$ wt. %, $0.8 \leqq Cu \leqq 7.5$ wt. % and $0.5 \leqq Mg \leqq 3.5$ wt. %, then the improvements are more effective. The reasons why these respective elements are to be added in the above specified proportion ranges are described in the following.

(a) Regarding Si:

Si is added principally for the purpose of lowering a coefficient of thermal expansion and improving an abrasion-proofness, and in accordance with increase of the amount of addition, Young's modulus is enhanced.

However, if the content is less than 10 wt. %, the effect of addition is not sufficient, and if it exceeds 30 wt. % a workability upon entrusion working, hot forging, machining, etc. is degraded and so, industrial utilization becomes difficult.

(b) As to Fe:

Fe is added for the purpose of improving fatigue strength and heat-resistivity of the mother alloy, recovering thermally affected portions produced in the periphery of the portion of the sintered body surface remelted by high-density energy of a laser beam or the like, and supplementing lowering of a strength caused by recrystallization, and in accordance with increase of the amount of addition, Young's modulus is enhanced.

However, if the content is less than 4 wt. %, the effect of addition is not sufficient, and if it exceeds 33 wt. %, density increases, and hence the effect of reducing weight is lost.

(c) Concerning Mn:

In manufacture of atomized powder, it is necessary to set so that a cooling speed of aluminium-alloy powder may become maximum, but in the case of taking the mass-productivity into consideration, a cooling rate of $10^3 \sim 10^5$ °C./sec is the limit.

Within this range of cooling rate, at the Fe content of Fe≦6 wt. %, since Al—Fe—Si series intermetallic compound can be fully severed during a hot extrusion working process and also since the precipitated state of the compound is granular, hot forging at a high speed to a certain extent is possible.

Whereas, at the Fe content of Fe≦6 wt. %, the precipitated state of the aforementioned intermetallic compound becomes acicular and a hot deformation resistance increases, so that high-speed hot forging becomes impossible.

Mn is effective for controlling a precipitated state of the above-described intermetallic compound. More particularly, by adding the above-referred particular amount of Mn, granular $Al_6$ (Fe, Mn) phase and $\alpha$-$Al_{12}$ (Fe, Mn)$_3$ Si phase are precipitated preferentially in place of acicular $Al_3Fe$ phase and $\beta$-$Al_5FeSi$ phase, thereby a high-speed hot foregeability is improved, and hence a strength of a structural member can be enhanced.

However, if the content is less than 1.5 wt. %, the above-described effect cannot be realized, and if it exceeds 5.0 wt. %, a hot deformation resistance increases, so that high-speed hot forging becomes difficult.

(d) With respect to Zn:

In order to enhance a strength of a member used under a temperature condition of 200° C. or lower, it is effective to subject the member to a T6 (solid solution aging) treatment and make use of a hardening phenomenon caused by precipitation of intermetallic compound produced by addition of Si, Cu, and Mg, and Zn has a function of promoting the aging precipitation.

However, if the content is less than 0.5 wt. %, the above-mentioned effect is not realized, and if it exceeds 10 wt. %, a hot deformation resistance increases, and hence, high speed hot forging becomes difficult.

Heretofore, in the case of adding Zn as an effective element, Si contained in aluminium-alloy was dealt with as an impurity. However, in the alloy according to the present invention, by applying the powder metallurgical process to manufacture of the alloy, Zn and Si are positively made to coexist, thereby enhancement of an abrasion-proofness and lowering of a coefficient of thermal expansion caused by proeutectic Si are achieved, and also it is possible to enhance a strength of the material by making use of a hardening phenomenon caused by precipitation of Zn compounds.

In this way, by adding Zn, a strength of a structural member after T6 treatment can be enhanced, so that it is possible to reduce a density of alloy, and accordingly, of a structural member and also improve a hot foregeability by reducing the amount of addition of Fe.

(e) Regarding Li:

Li is employed for the purpose of suppressing the increase in density of alloy caused by addition of Fe, and the suppressing effect is enhanced in accordance with increase of the amount of addition of Li. In addition, Li also has a function of enhancing a Young's modulus and giving a high rigidity to the alloy.

However, if the content is less than 1.0 wt. %, the density rise suppressing effect is little, while if it exceeds 5.0 wt. %, it becomes an issue that since Li is active, the manufacturing process becomes more complex (f) As to Co:

Co is effective for improving high-temperature strength in the case where an iron content was reduced for improving forging workability, it can enhance tensile strength, proof stress and a fatigue strength without degrading ductility, and also it is possible to enhance high-temperature strength without deteriorating anti-stress, anti-corrossion anti-cracking properties and forging workability.

However, if the content is less than 0.5 wt. %, the effect is little, while if it exceeds 3.0 wt. %, then the improving effect becomes not so remarkable as the increase of the amount of addition, and especially in view of the fact that Co is expensive, the amount of addition of Co is limited to 3.0 wt. % or less.

(g) Concerning Cu:

Cu is added for the purpose of compensating for degradation of sinterability and a shapability caused by addition of Fe and Si.

However, if the content is less than 0.8 wt. %, the effects of improving sinterability and improving strength by heat treatment are not present, while if it exceeds 7.5 wt. %, high-temperature strength is deteriorated.

(h) With respect to Mg:

Mg is added for a similar purpose to Cu.

However, if the content is less than 0.5 wt. %, the effects of improving sinterability and improving strength by heat treatment are not present, while if it exceeds 3.5 wt. %, high-temperature strength is deteriorated.

In this connection, in the case of a structural member to which a stress is always applied such as, for example, a connecting rod, for the purpose of improving anti-stress, anti-corrosion, anticracking properties and enhancing a durability of the structural member, it is desirable to limit Cu and Mg in the alloy to the degree of impurities, and so, Cu is made less than 0.8 wt. %, Mg is made less than 0.5 wt. %, and preferably both Cu and Mg are made less than 0.1 wt. %, respectively.

In the alloy having the above-described range of composition, besides Si crystals, intermetallic compounds such as $Al_3Fe$, $Al_{12}Fe_3Si$, $Al_9Fe_2$, $Si_2$, etc. are precipitated in a matrix. The grain sizes of these must be 1 μm or smaller in the layer subjected to remelting-solidifying treatment on the surface of the sintered body, and must be 10 μm or smaller in the base portion which was not subjected to the same treatment. The reason is because if the grain sizes of the Si crystal grain and the other precipitates exceed 1 μm in the surface layer, a sensitivity to notching becomes high, hence cracks are apt to be generated, and so, a sufficient fatigue strength enhancing effect can be hardly expected, and because if these grain sizes exceed 10 μm in the base portion, enhancement of a fatigue strength of the structural member can be hardly expected and also a shapability is degraded.

DESCRIPTION OF PREFERRED EMBODIMENTS

Examples of Tests (1) Al-alloys having the compositions (A,B,C,—, S) shown in Table-1 are pulverized through an atomizing process, and by making use of the respective alloy powders A,B,C,—, S, raw materials for use in extrusion work having a diameter of 225mm and a length of 300mm are shaped through a cold hydrostatic pressure press-shaping process (C.I.P. process) or a mold pressing process.

In the cold hydrostatic pressure press-shaping process, the alloy powder is charged in a tube made of rubber and the shaping is effected under a hydrostatic pressure of about 1.5~3.0 t/cm$^2$. In the mold pressing process, the alloy powder is charged in a metallic mold and the shaping is effected at a room temperature within the atmosphere under a pressure of about 1.5~3.0t/cm$^2$.

The obtained raw materials for use in extrusion work are placed in a soaking pit having a furnace temperature of 350° C. and held for 10 hours, subsequently the respective raw materials for extrusion work are subjected to hot extrusion work, and thereby circular rod-shaped forging raw materials of 70 mm in diameter consisting of alloys A,B,C,—, S, respectively, are produced.

In this case, the extrusion process could be either a direct extrusion process (forward extrusion process) or an indirect extrusion process (backward extrusion process), but the extrusion ratio is necessitated to be 5 or larger. An extrusion ratio smaller than 5 is not favorable because dispersion of strengths becomes large. The temperature of the raw materials to be used for extrusion work is normally set at 330°~520° C. If the temperature is lower than 330° C., a deformation resistance of the raw material becomes large, resulting in deterioration of an extrusion workability, while if it exceeds 520° C., then there is a fear that the raw material may melt locally and bubbles may be generated. After the extrusion work, the raw material for forging is cooled at a predetermined cooling rate by air cooling or water cooling.

Thereafter, the respective circular rod-shaped raw materials for forging were cut into a predetermined size to provide test pieces, then the respective test pieces were heated up to 460°~470° C., and they were subjected to high-speed hot forging work by means of a crank press having a working speed of 75 mm/sec (nearly the same working speed as forging of duralumin).

The obtained forging-shaped articles (sintered bodies) were subjected to T6 treatment (after holding them at 495° C. for 4 hours, they were water-cooled and subsequently held at 175° C. for 6 hours) in the case of the alloys A,B,C,~, N, but in the case of the alloys O,P,~, S, they were air-cooled from the forging temperature.

From the heat-treated forging-shaped article, test pieces for Ono rotational bending fatigue test were cut out. A parallel portion of the test piece was irradiated with a carbon dioxide gas laser beam to perform surface hardening treatment by remelting-solidification; thereafter flat surfaces were ground, and rotational bending fatigue test was conducted at a room temperature. The test pieces were picked up respectively eight for all of the alloys A,B,C,—, S, a fatigue strength (Kg/mm$^2$) was obtained for $N=10^7$, where N represents the number of repetitions of bending. The results are shown in Table-2 (numbered column 4); similar tests were conducted also for the test pieces which were not subjected to the surface hardening treatment, and the results are also shown in Table-2 (numbered column 3).

In addition, the grain sizes (μm) of the Si crystal grains and the precipitated intermetallic compound in the base portion not subjected to the surface hardening treatment of the respective test pieces are shown in numbered column 1, and the grain sizes of the Si crystal grains and the precipitated intermetallic compound in the surface layer which was subjected to the hardening treatment are shown in numbered column 2.

(2) Furthermore, for the purpose of confirming the effects of the present invention, with respect to Al-alloys having the composition (a,b,c) shown in Table-1, shaped articles similar to the forging shaped articles as described in the preceding paragraph(1) were prepared through a metallic mold casting process (a,b) and through a forging work(c). The shaped articles were subjected to the T6 treatment or the T4 treatment (after being held at 500° C. for 4 hours, they are water-cooled and aged at a room temperature), then test pieces similar to those described in the preceding paragraph (1) were cut out from the treated articles to be tested, and the results are shown in Table-2 (numbered columns 1 to 4).

As will be apparent from the results shown in Table-2, with respect to the test pieces of the examples (A,B,-C,—, S) according to the present invention, in either of the base portion and the surface layer, the grain sizes of the Si crystal grains and the precipitated intermetallic compound are sufficiently small as compared to those of the test pieces of the contrast examples (a,b,c), and the fatigue strengths of the test pieces of the examples according to the present invention are remarkably large as compared to the test pieces of the contrast examples.

Also it can be seen that in the case of the contrast examples, even if micro-fining of the Si crystal grains and the precipitated intermetallic compound in the surface layer is effected by subjecting the test pieces to remelting-solidifying treatment, a fatigue strength can be hardly enhanced, whereas in the case of the examples according to the present invention, a fatigue strength can be considerably improved.

As will be apparent from the above description, according to the present invention, a high strength structural member, in which a surface layer of a sintered body formed of Al-alloy powder containing Si and Fe in the proportions of $10 \leqq Si \leqq 30$ wt. % and $4 \leqq Fe \leqq 33$ wt. % has been subjected to remelting-solidifying treatment with a high-density energy source, whereby grain sizes of Si crystal grains and precipitated intermetallic compound in the remelted-solidified layer are made 1 μm or smaller and grain sizes of Si crystal grains and precipitated intermetallic compound in the base portion that is not subjected to the remelting-solidifying treatment are 10 μm or smaller, has been provided. This member has a fatigue strength greatly exceeding that of the known materials, and expecially it can be effectively applied to an internal combustion engine as a member having a high strength, a large rigidity and a light weight.

While a principle of the present invention has been described above in connection to preferred embodiments of the invention, it is intended that all matter contained in the above-description shall be interpreted to be illustrative and not in a limiting sense.

TABLE 1

| | Added Elements (weight %) | | | | | | | | | Process for Making Raw Material | Process for manufacture | Note |
|---|---|---|---|---|---|---|---|---|---|---|---|---|
| | Si | Cu | Mg | Fe | Mn | Zn | Ni | Li | Co | | | |
| Examples according to the Present Invention | | | | | | | | | | | | |
| A | 17.2 | 4.5 | 1.2 | 8.0 | — | — | — | — | — | Powder Extrusion | Forging | T6 |
| B | 15.2 | 3.9 | 1.9 | 6.8 | — | — | — | — | — | " | " | " |
| C | 17.2 | 4.5 | 1.2 | 8.0 | 2.0 | — | — | — | — | " | " | " |
| D | 17.0 | 6.0 | 2.0 | 8.0 | 1.8 | — | — | — | — | " | " | " |
| E | 15.1 | 4.1 | 1.8 | 9.2 | 4.5 | — | — | — | — | " | " | " |
| F | 15.1 | 4.2 | 0.62 | 4.3 | — | 2.6 | — | — | — | " | " | " |
| G | 17.0 | 3.8 | 1.90 | 4.0 | — | 3.2 | — | — | — | " | " | " |
| H | 15.1 | 3.8 | 0.60 | 5.0 | — | 5.5 | — | — | — | " | " | " |
| I | 17.1 | 4.2 | 1.8 | 6.8 | 2.3 | 3.5 | — | — | — | " | " | " |
| J | 15.8 | 4.5 | 2.1 | 8.5 | 3.4 | 2.6 | — | — | — | " | " | " |
| K | 17.1 | 4.2 | 1.8 | 6.8 | 2.3 | 2.7 | — | 1.4 | — | " | " | " |
| L | 17.2 | 4.5 | 1.2 | 7.5 | 1.6 | 3.0 | — | 3.0 | — | " | " | " |
| M | 17.8 | 4.1 | 1.2 | 4.8 | — | — | — | — | 1.6 | " | " | " |
| N | 15.5 | 4.3 | 1.2 | 4.6 | 1.8 | 2.2 | — | 2.2 | 0.8 | " | " | " |
| O | 17.2 | 0.06 | 0.05 | 6.4 | — | — | — | — | — | " | " | Cooling after forging |
| P | 17.2 | 0.06 | 0.05 | 6.2 | 2.0 | — | — | — | — | " | " | " |
| Q | 16.1 | 0.08 | 0.06 | 5.4 | — | — | — | 3.0 | — | " | " | " |
| R | 17.5 | 0.06 | 0.05 | 4.6 | — | — | — | — | 2.2 | " | " | " |
| S | 16.8 | 0.04 | 0.07 | 4.4 | 1.6 | — | — | 2.2 | 1.6 | " | " | " |
| Contrast Examples | | | | | | | | | | | | |
| a | 12.2 | 0.9 | 0.8 | 0.5 | — | — | 1.4 | — | | Melting Process | Metal Mold Casting | JIS AC8A,T6 |
| b | 16.5 | 4.4 | 0.5 | 0.4 | — | — | — | — | | " | " | AA standard A390,T6 |
| c | — | 4.2 | 0.5 | 0.3 | 0.5 | — | — | — | | " | Forging | JIS 2017,T4 |

TABLE 2

| | Diameters of Si Grains and Intermetallic Compound (μm) | | Fatigue Strength (kg/mm²) | |
|---|---|---|---|---|
| | 1. Base Portion | 2. Surface Layer | 3. Untreated | 4. Treated |
| Examples according to the Present Invention | | | | |
| A | 8 | 0.8 | 21 | 27 |
| B | 7 | 0.7 | 20 | 27 |
| C | 8 | 0.8 | 22 | 28 |
| D | 8 | 0.8 | 23 | 28 |
| E | 7 | 0.9 | 24 | 29 |
| F | 7 | 0.7 | 22 | 27 |
| G | 8 | 0.8 | 23 | 28 |
| H | 7 | 0.8 | 24 | 30 |
| I | 8 | 0.8 | 23 | 29 |
| J | 8 | 0.9 | 25 | 31 |
| K | 8 | 0.8 | 24 | 30 |
| L | 9 | 0.9 | 25 | 32 |
| M | 8 | 0.7 | 19 | 23 |
| N | 10 | 0.9 | 25 | 30 |
| O | 8 | 0.7 | 18 | 23 |
| P | 9 | 0.9 | 20 | 25 |
| Q | 8 | 0.7 | 18 | 23 |
| R | 8 | 0.8 | 22 | 27 |
| S | 9 | 0.8 | 24 | 28 |
| Contrast Examples | | | | |
| a | 120 | 80 | 8.0 | 8.5 |
| b | 80 | 10 | 7.5 | 7.6 |
| c | 50 | 4 | 9.0 | 9.5 |

What is claimed is:

1. A high strength structural member made of Al-alloy produced by the process comprising:

(a) pulverizing an aluminum alloy containing between 10 and 30 weight percent Si and between 4 and 33 weight percent Fe as solids in the supersaturated state through an atomizing process and quenching at a rate greater than $10^{30}$0° C./sec so as to produce particles of non-aluminum components smaller than 10 μm;

(b) pressing said powder in a mold;

(c) sintering by extrusion at a temperature between 330° C. and 520° C.; and (d) subjecting the surface of the sintered body to a remelting-solidifying treatment using a high-density energy source to reduce the size of the crystal grains of non-aluminum compounds in the treated area to less than or equal to 1 μm.

2. A high strength structural member made of Al-alloy according to claim 5, wherein said sintered body is formed of Al-alloy powder containing Si, Fe, Cu, Mg and at least one element selected from a group consisting of Mn, Zn, Li and Co in the proportion ranges (wt. %) of: $10 \leqq Si \leqq 30$, $4 \leqq Fe \leqq 33$, $0.8 \leqq Cu \leqq 7.5$, $0.5 \leqq Mg \leqq 3.5$, $1.5 \leqq Mn \leqq 5.0$, $0.5 \leqq Zn \leqq 10$, $1.0 \leqq Li \leqq 5.0$, and $0.5 \leqq Co \leqq 3.0$.

3. A high strength structural member made of Al-alloy according to claim 1, wherein the amount of Cu and Mg contained as inevitable impurities in the Al-alloy powder forming said sintered body fall in the ranges of $Cu \leqq 0.8$ wt. % and $Mg \leqq 0.5$ wt. %.

4. A high strength structural member made of Al-alloy according to claim 1, wherein said sintered body is formed of Al-alloy powder containing, in addition to Si and Fe, at least one element selected from the group consisting of Mn, Li and Co in the proportion ranges (wt. %) of: $10 \leqq Si \leqq 30$, $4 \leqq Fe \leqq 33$, $1.5 \leqq Mn \leqq 5.0$, $1.0 \leqq Li \leqq 5.0$ and $0.5 \leqq Co \leqq 3.0$, and among inevitable impurities, contents of at least Cu and Mg falling in the ranges of $Cu \leqq 0.8$ wt. % and $Mg \leqq 0.5$ wt. %.

* * * * *

UNITED STATES PATENT AND TRADEMARK OFFICE

CERTIFICATE OF CORRECTION

PATENT NO. : 4,711,823

DATED : December 8, 1987

INVENTOR(S) : Haruo SHIINA

It is certified that error appears in the above-identified patent and that said Letters Patent is hereby corrected as shown below:

Claim 1, column 8, line 31, "$10^{30}0$°C./sec" should read --$10^{3}$ °C./sec.--.

Claim 2, column 8, line 43, "claim 5" should read --claim 1--.

Signed and Sealed this

Sixth Day of September, 1988

*Attest:*

*Attesting Officer*

DONALD J. QUIGG

*Commissioner of Patents and Trademarks*